US006009290A

United States Patent [19]

Mochida

[11] Patent Number: 6,009,290

[45] **Date of Patent: *Dec. 28, 1999**

[54] IMAGE FORMING APPARATUS AND BELT MEMBER

[75] Inventor: Yoshinori Mochida, Yokohama, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/754,655

[22] Filed: Nov. 21, 1996

[30] Foreign Application Priority Data

Nov. 22, 1995 [JP] Japan ..... 7-326242

[51] Int. Cl.[6] ..... G03G 15/00

[52] U.S. Cl. ..... 399/162

[58] Field of Search ..... 399/159, 162, 399/164, 302, 303, 299, 298, 297

[56] References Cited

U.S. PATENT DOCUMENTS

| | | | |
|---|---|---|---|
| 4,899,196 | 2/1990 | Mahoney | 399/302 |
| 5,196,893 | 3/1993 | Nishise et al. | 399/303 X |
| 5,291,245 | 3/1994 | Charnitski et al. | 399/162 X |
| 5,600,421 | 2/1997 | Takekoshi et al. | 399/299 X |
| 5,613,175 | 3/1997 | Frankel | 399/162 |

FOREIGN PATENT DOCUMENTS 63-280277 11/1917 Japan .

*Primary Examiner*—Sandra Brase

*Attorney, Agent, or Firm*—Fitzpatrick, Cella, Harper & Scinto

[57] ABSTRACT

An image forming apparatus includes: a rotatable belt having a seamed portion and a reinforcing member attached to the seamed portion; rollers for supporting and feeding the belt; and an image forming device for forming an image on the belt or on a recording material carried thereby, wherein the reinforcing member is arranged on the belt such that it crosses a direction perpendicular to the direction of rotation of the belt. The seamed portion is parallel to the direction perpendicular to the direction of rotation of the belt. The reinforcing member includes folded portions at both ends of the belt with respect to the direction perpendicular to the direction of rotation, the folded portions being formed by folding over the end portions of the reinforcing member from the obverse to the reverse side of the belt. The end portions of the reinforcing member are arranged such that the end portion on the obverse side of the belt and that on the reverse side thereof are not exactly superimposed one upon the other but out of alignment with respect the direction of rotation of the belt. The apparatus further has a cleaning blade for cleaning the belt, wherein the line in which this cleaning blade is in contact with the belt is parallel to the direction perpendicular to the direction of rotation of the belt, and a plurality of image bearing members, wherein images of plurality of colors are transferred from these image bearing members to the recording material carried by the belt.

19 Claims, 6 Drawing Sheets

IMAGE FORMING APPARATUS AND BELT MEMBER

BACKGROUND OF THE INVENTION

1. Field of the Invention

The present invention relates to a belt member having a seamed portion and to an image forming apparatus having this belt member. This image forming apparatus is suitable for use as a color-type image forming apparatus in which images of a plurality of colors are superimposed one upon the other on a recording material carried by the belt member.

2. Description of the Related Art

Conventionally, there have been proposed various types of color image forming apparatuses. In these image forming apparatuses, a plurality of image forming sections are provided, and toner images of different colors are respectively formed in these image forming sections, the toner images being transferred to the same recording material and superimposed one upon the other. Of such image forming apparatuses, a color copying apparatus of a multicolor electrophotographic type is in wide use.

An example of such a color electrophotographic copying apparatus will be briefly described with reference to FIG. 6. In the body of the color electrophotographic copying apparatus, first through fourth image forming sections Pa, Pb, Pc and Pd are arranged side by side. The image forming sections Pa through Pgd are equipped with electrophotographic photosensitive drums 1*a*, 1*b*, 1*c* and 1*d*, respectively, which serve as dedicated image carrying means.

Around the photosensitive drums 1*a* through 1*d*, there are arranged latent image forming sections 2*a*, 2*b*, 2*c* and 2*d*, developing sections 3*a*, 3*b*, 3*c* and 3*d*, and cleaning sections 5*a*, 5*b*, 5*c* and 5*d*, respectively.

Under the image forming sections Pa through Pd, a conveyor belt 8 for conveying the recording material to the respective image transfer positions is arranged such that it can run by means of a driving roller 12 and a driven roller 11. Inside the conveyor belt 8, transfer discharge sections 4*a*, 4*b*, 4*c* and 4*d* are arranged respectively in correspondence with the photosensitive drums.

In this construction, first, a latent image of cyan color component is formed on the photosensitive drum 1*a* of the first image forming section Pa by the latent image forming section 2*a* on the basis of image information read from an image reader (not shown). This latent image is turned into a visual image by using a developer of the developing section 3*a* having cyan toner. Then, the image transfer section 4*a* transfers the cyan toner image onto a recording material 6, which is supplied from a recording material cassette 60, fed by way of registration rollers 13 and conveyed by the conveyor belt 8.

While the cyan image is being transferred to the recording material 6 as described above, a latent image of magenta color component is formed by the second image forming section Pb. Then, this latent image is turned into a magenta toner image by the developing section 3*b* and transferred onto a predetermined position of the recording material 6 so as to be superimposed on the cyan toner image when the recording material 6, which has undergone image transfer in the first image forming section Pa, is fed to the image transfer section 4*b*.

By similar processes, yellow and black images are formed by the third and fourth image forming sections Pc and Pd, and the yellow and black colors are transferred onto predetermined positions of the same recording material 6 so as to be superimposed on the cyan and magenta images.

When these image forming processes have been completed, the image on the recording material 6 is fixed to the recording material 6 by a fixing section 7, whereby a multicolor image is completed.

After the completion of the image transfer, the toner remaining on the photosensitive drums 1*a* through 1*d* is removed by cleaning sections 5*a* through 5*d*, and the apparatus made ready for forming the next latent image.

The conveyor belt 8, which is an endless belt member, consists of a dielectric resin film, such as a polyethylene terephthalate resin sheet (PET sheet), a polyvinylidene fluoride resin film, or a polyurethane resin film. The end portions of the belt are superimposed one upon the other to be joined together to be thereby formed into an endless belt. Alternatively, a so-called seamless belt having no seam may be used.

However, of the above-mentioned conventional belts, the seamless belt is rather difficult to produce, and has serious problems in terms of productivity, cost, etc.

On the other hand, the so-called seamed belt having a seam involves a problem when image transfer is effected on that portion of the recording material which is being held by the belt portion corresponding to the seamed portion; the portion of the recording material superimposed on the seam portioned has physical properties that are different from those of the remaining portion of the recording material, so that the transfer electric field of this portion of the recording material differs from that of the remaining portion thereof, resulting in an image disturbance. As a result, a defective image is generated, which has inconsistency in density appearing in the form of a line corresponding to the seamed portion.

To prevent the generation of such inconsistency in density, various measures have been proposed. For example, use of the belt is started from a position which is spaced apart from the seam position by a predetermined distance in order that the recording material may not be placed on the seamed portion.

Further, a method has been proposed according to which, in order that the recording material may not be placed on the seamed portion, the seamed portion is detected to adjust the timing with which the recording material is placed on the conveyor belt.

However, the above-mentioned seamed belt still has the following problems:

The first problem relates to the strength of the belt. The belt is stretched between a plurality of conveying rollers and conveys the recording material as it runs, so that it is repeatedly wound around the conveying rollers and separated therefrom. That is, the belt repeatedly receives bending stress, which means the fatigue strength of the belt is an important factor to be taken into consideration.

The bonding of the seamed belt is effected by adhesion bonding using an adhesive, heat bonding using heat, etc. In any case, the fatigue strength of the bonded section cannot exceed that of the remaining portion of the belt, with the result that cracks are generated in the bonded section after being used for a long period of time, which leads to a break in the belt. Thus, the service life of the belt is rather short.

Japanese Unexamined Patent Publication No. 63-280277, for example, discloses a structure in which, in order to prevent erroneous detection by a sensor, the seam of the transfer belt extends in a direction crossing the direction perpendicular to the movement of the belt. This structure, however, has a problem in terms of the belt strength.

Regarding the above problem, it is known that a substantial improvement can be achieved by attaching a thin adhesive tape (consisting, for example, of a polyester or a teflon (trade name) tape), which constitutes a reinforcing member, to the surface of the bonded section of the belt. However, even this arrangement is insufficient in preventing the generation of cracks starting from the end portions with respect the width direction of the belt. Thus, a further improvement is required in this regard.

Further, both the conveyor belt as the conveying means and the photosensitive belt as the image carrying means have cleaning means which are in contact with their surfaces, and when the step portion formed by the adhesive tape passes the cleaning means, vibrations and uneven rotation, which lead to displacement of the belt, are generated, resulting in unevenness in the image. In particular, in the case of a color image forming apparatus, such vibrations and uneven rotation will lead to color misregistration.

SUMMARY OF THE INVENTION

It is an object of the present invention to improve the strength of a belt member of the type which has a seam.

Another object of the present invention is to provide a belt member and an image forming apparatus which prevent unevenness in speed and vibrations due to the reinforcing member provided on the seam.

Still another object of the present invention is to provide a belt member and an image forming apparatus in which the bending strength of the seam of the belt member is improved to thereby improve the durability of the belt member.

DESCRIPTION OF THE PREFERRED EMBODIMENTS

Figure 1:
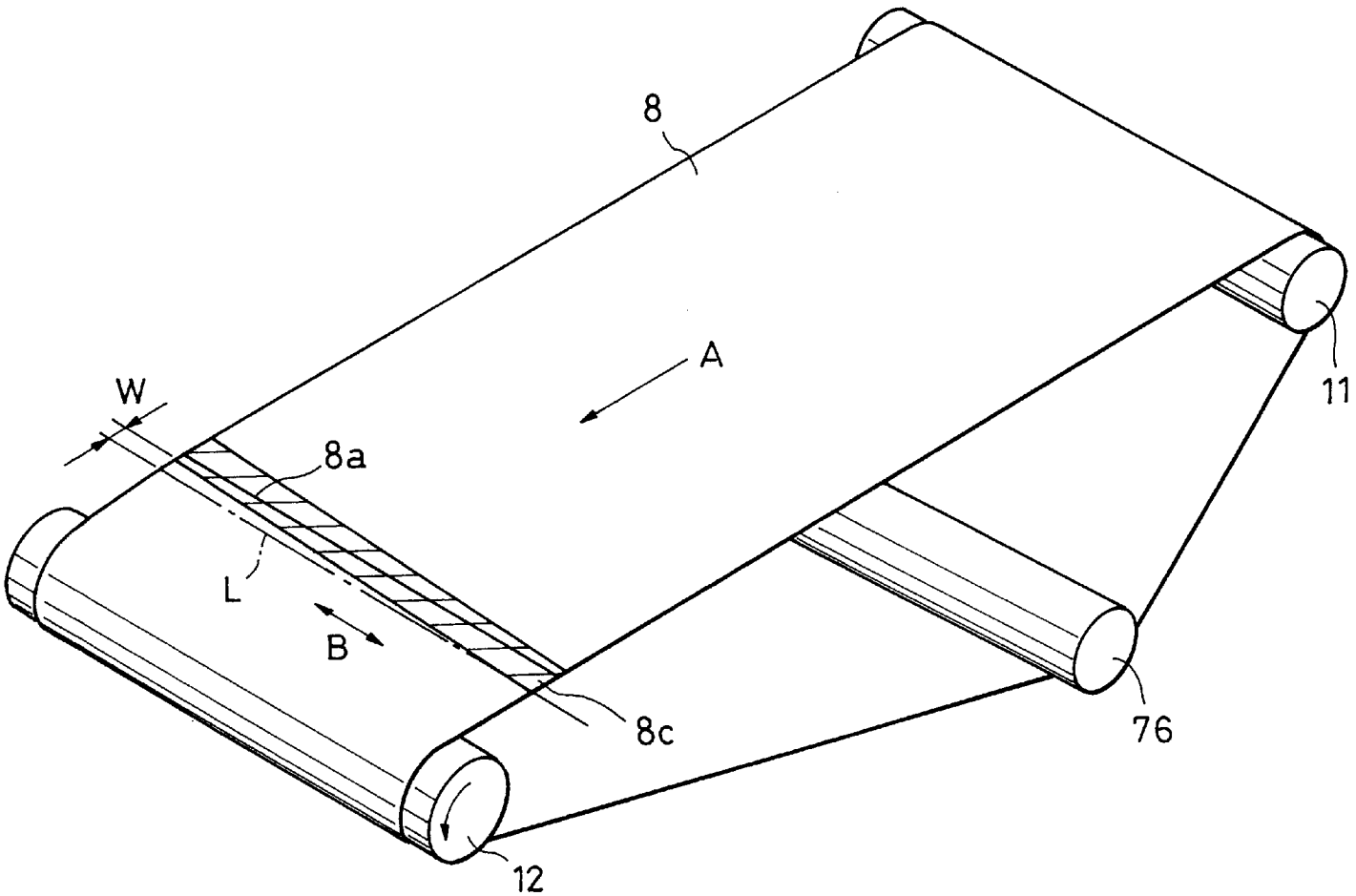
FIG. 1 is a perspective view showing an endless conveyor belt according to an embodiment of the present invention, with a reinforcing adhesive belt attached thereto.

A belt member and image forming apparatus according to the present invention will now be described in more detail with reference to the drawings.

Prior to the description of the essential parts of the apparatus of the present invention, the operation of the entire image forming apparatus will be described. In the description, the members having functions which are the same as those of the counterparts of the above-described conventional apparatus will be indicated by the same reference numerals.

Figure 5:
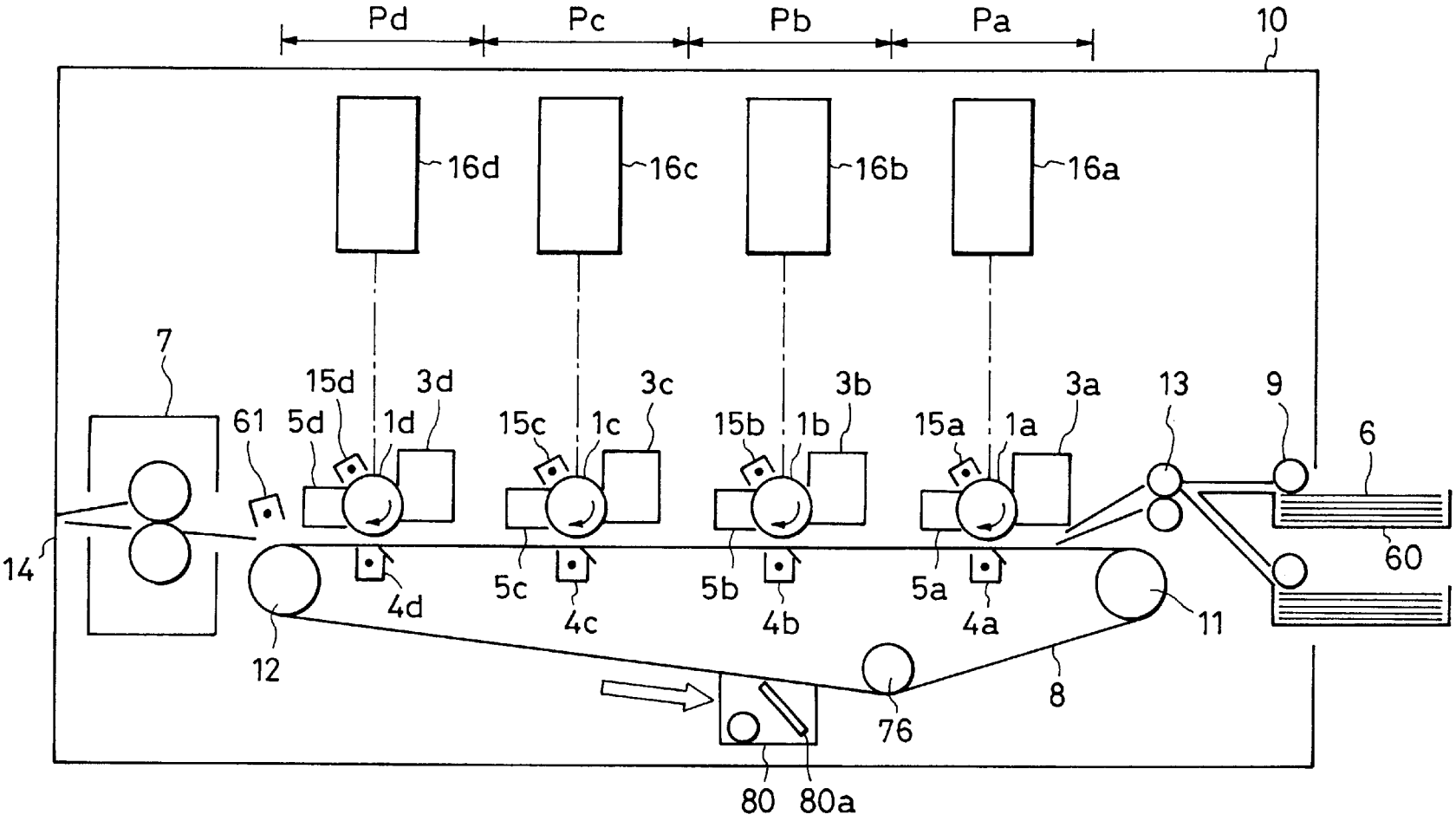
FIG. 5 is a schematic overall view of the image forming apparatus according to an embodiment of the preset invention.
Figure 6:
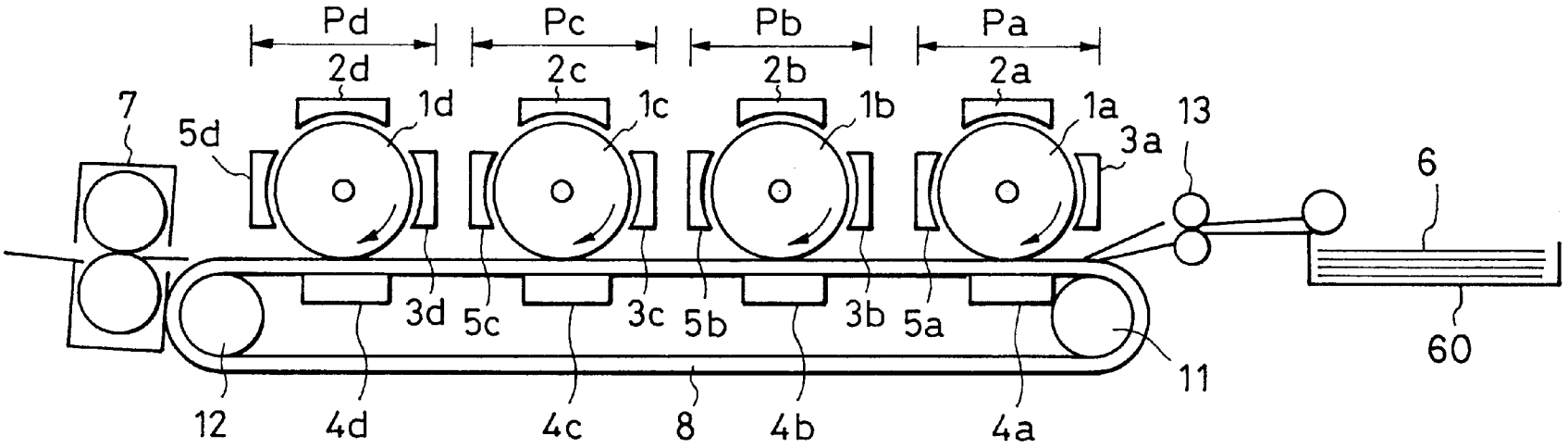
FIG. 6 is a conceptual drawing showing a conventional image forming apparatus.

Referring to FIG. 5, the belt member and the image forming apparatus of this embodiment is realized as a color electrophotographic copying apparatus substantially similar to the apparatus described with reference to FIG. 6. Thus, in this embodiment, the image forming apparatus has a plurality of image forming sections Pa, Pb, Pc and Pd arranged in an apparatus body 10. Under these image forming sections, there is provided a conveying means, which is composed of a driving roller 12, a driven roller 11, a tension roller 76, and a seamed conveyor belt 8 wound around these rollers and having an entire length of 1000 mm. The conveyor belt 8 runs in an endless manner in the direction indicated by the arrow at a speed of 100 mm/sec.

In this embodiment, the conveyor belt 8 consists of a polyurethane resin film sheet which is bonded by an ultrasonic fusing method. Apart from this, in this embodiment, a film of synthetic resin, such as PVDF (polyvinylidene fluoride) resin using polyurethane resin, PET (polyethylene terephthalate) resin, PEN (polyethylene naphthalate) resin, polycarbonate resin, or polyether sulfonate resin, can be suitably used. Further, the bonding method is not restricted to the ultrasonic fusing method but other bonding methods are also applicable.

The first, second, third and fourth image forming sections Pa, Pb, Pc and Pd, arranged side by side above the conveyor belt 8, have photosensitive drums 1*a*, 1*b*, 1*c* and 1*d*. Chargers 15*a*, 15*b*, 15*c* and 15*d* are provided above these photosensitive drums 1*a*, 1*b*, 1*c* and 1*d*, respectively.

Further, laser beam scanners 16*a*, 16*b*, 16*c* and 16*d* are arranged above the photosensitive drums 1*a* through 1*d*. These laser beam scanners 16*a*, 16*b*, 16*c* and 16*d* are composed of semiconductor lasers, polygon mirrors, fθ lens, etc. They receive input electric digital image signals, and perform scanning with laser beams, which are modulated in response to these signals, between the chargers 15*a* through 15*d* and the developing units 3*a*, 3*b*, 3*c* and 3*d* and in the generatrix direction of the photosensitive drums 1*a*, 1*b*, 1*c* and 1*d* to thereby effect exposure thereon.

When an image formation start signal is input to the image forming apparatus of this embodiment, the photosensitive drum 1*a* starts to rotate in the direction indicated by the arrow, and is uniformly charged by the charger 15*a*. After this, a laser beam modulated by an image signal corresponding to the black component image of the original image is written by the laser beam scanner 16*a*, whereby a latent image is formed. Next, the latent image is developed by using the toner in the developing unit 3*a*, and a black toner image is formed on the photosensitive drum 1*a*.

A recording material 6 is extracted from a recording material cassette 60 by a pick-up roller 9 and is conveyed to registration rollers 13 provided in the vicinity of the driving roller 11. The recording material 6, which is temporarily stopped at the registration rollers 13, is fed onto the conveyor belt 8, which has already started to rotate, by the registration rollers 13. In this feeding operation, the recording material 6 is timed to the toner image formed on the photosensitive drum 1*a*. The recording material 6, fed onto the conveyor belt 8 while being timed to the toner image, receives transfer charge from the transfer charger 4*a* via the back side of the conveyor belt 8, whereby the black toner image on the photosensitive drum 1*a* is transferred to the recording material.

This process is similarly performed in the remaining image forming sections Pb, Pc and Pd, and a magenta toner image, a yellow toner image, and a cyan toner image are sequentially superimposed on the recording material 6. The color order of the toner images is not restricted to that of this embodiment.

The recording material 6, which has undergone all the image transfer processes, is separated from the conveyor belt 8 while it undergoes AC charge removal by a separation charger 61 arranged substantially over the driving roller 12 before it is sent to the fixing section 7. In the fixing section 7, the toner image on the recording material 6 undergoes color mixing by heat and is fixed to the recording material before it is discharged to the exterior of the apparatus body 10 through a discharge outlet 14.

The toner remaining on the surfaces of the photosensitive drums 1*a* through 1*d* is removed by the cleaning devices 5*a*, 5*b*, 5*c* and 5*d*, and the apparatus is made ready for the next image forming process.

Such is the main sequence of image formation. When a high-quality image is to be obtained by a plurality of image transfer processes, the quality of each image should be well-balanced. In view of this, in order to control the electric potential of each photosensitive drum, an electric potential sensor for detecting the surface potential of the photosensitive drum is provided, or it is advisable to perform preparatory operations on the transfer belt, such as charge removal and cleaning. These preparatory operations are referred to as a pre-rotation sequence.

Cleaning means 80 for the conveyor belt 8 may be of a blade type or a brush type. In the case of the former type, a cleaning blade 80*a* is provided. In this case, little vibration is entailed during cleaning, so that little wow and flutter is involved, which means it does not exert great influence in terms of unevenness in image despite the fact that it is constantly in contact with the belt. Further, in order that the toner adhering to the conveyor belt may not be allowed to be fused by being left unattended, cleaning is effected by a post-rotation sequence after the image has been output. The line in which the cleaning blade 80*a* is in contact with the belt 8 is preferably perpendicular to the rotating (running) direction of the belt 8.

Such is the outline of the entire image forming apparatus of this embodiment. Next, an embodiment of the conveyor belt, which constitutes a principal part of the present invention, will be described in detail.

Referring to FIGS. 1 through 4, the conveyor belt 8 has a seamed portion 8*a*, to the surface of which is attached a reinforcing adhesive tape 8*c* serving as a reinforcing member for reinforcing the seamed portion 8*a*. The adhesive tape 8*c* is inclined by W mm with respect to a line L which is perpendicular to the direction of movement of the conveyor belt (the direction of the arrow A). That is, the seamed portion 8*a* is provided so as to cross the line L.

In this embodiment, in which the width of the conveyor belt 8 is 330 mm, the dimension W is set to be in the range of 2 to 20 mm so that the recording material may be suction-attached to and conveyed by the conveyor belt 8 without being placed on the seamed portion and that this dimension W may be smaller than the intervals at which the recording materials are successively conveyed (i.e., the intervals between the sheets). Regarding the angle θ made by the adhesive tape and the line L, the larger the angle, the higher the effect of reducing unevenness in rotation. However, it is desirable, as in this embodiment, to set the angle in the range of $0.30° < \theta < 3.5°$, taking into account the fact that an excessive increase in the width of the reinforcing member would result in a partial increase in the rigidity of the belt as well as in an increase in the above-mentioned intervals between the sheets, which would lead to an increase in throughput.

Further, the line in which the cleaning blade 80 is in contact with the belt 8 is parallel to the line L (that is, in the direction of the arrow B), so that the line in which the cleaning blade 80 is in contact with the belt 8 crosses the reinforcing member 8*c*.

Due to this arrangement, the cleaning blade 80, which is the cleaning means for the conveyor belt 8, gets over the adhesive tape 8*c* of the seamed portion 8*a* little by little, so that the bound of the blade due to the presence of the seamed portion 8*a* is restrained, thereby achieving an improved cleaning performance. At the same time, this helps to mitigate the generation of unevenness in speed (unevenness in rotation) and vibration (impact), thereby preventing a deterioration in image quality, such as inconsistency in image density or color misregistration.

Figure 2:
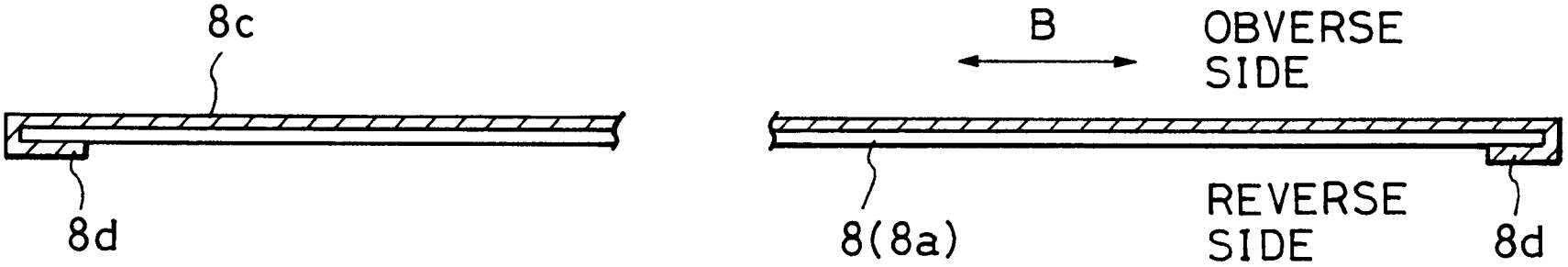
FIG. 2 is a sectional view showing the conveyor belt of FIG. 1.
Figure 3:
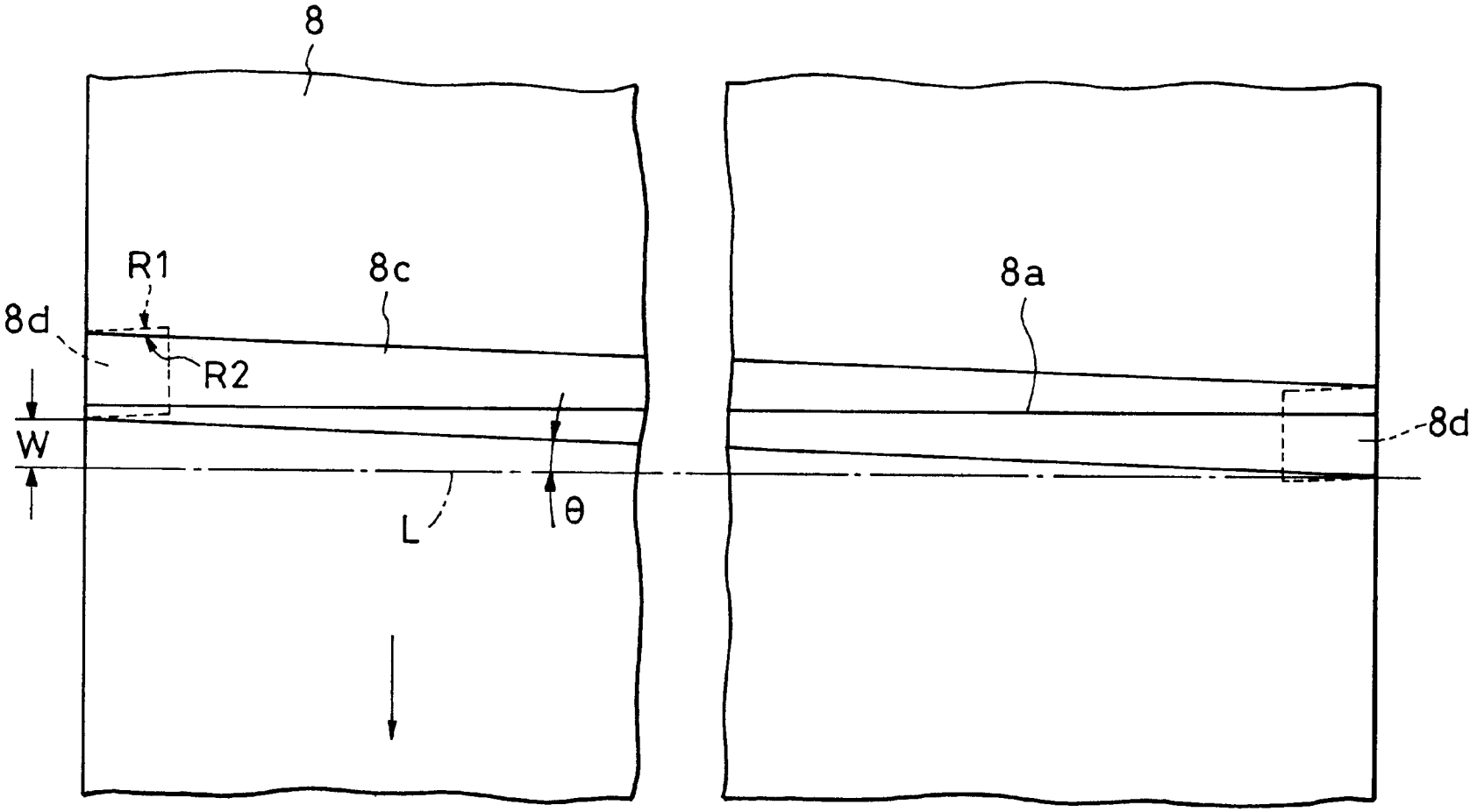
FIG. 3 is a plan view showing the conveyor belt of FIG. 1.
Figure 4:
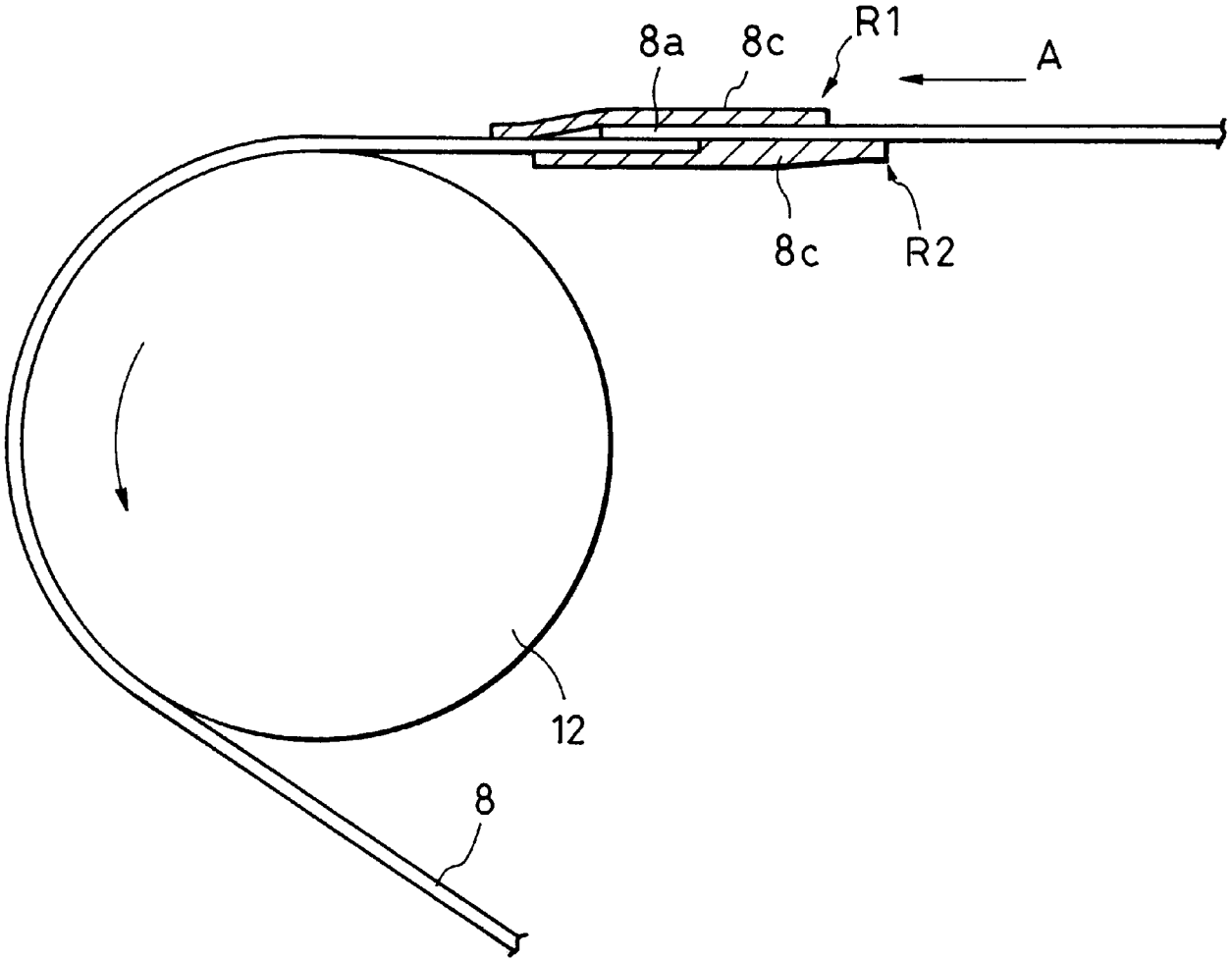
FIG. 4 is a sectional view of the essential part of the conveyor belt of FIG. 1, showing the seam portion thereof.

Further, as shown in FIG. 2, the end portions of the reinforcing adhesive tape 8*c* with respect to the direction (the direction B) which is perpendicular to the direction in which the conveyor belt 8 rotates (runs) are formed as folded sections 8*d*, which are formed by folding the end portions over such that the end portions extend from the obverse to the reverse side of the belt. Due to these folded sections, an improvement is achieved in terms of the resistance to the generation of cracks starting from the ends with respect to the direction perpendicular to the direction in which the belt runs. Thus, the strength of the seamed portion is enhanced with respect to the bending fatigue as described with reference to the conventional example, thereby increasing the service life of the belt. In this embodiment, the length of the folded end sections is 5 mm, which, however, should not be construed restrictively.

Further, while the material used in this embodiment is a polyester film having a thickness of approximately 3 to 50 μm, the same effect can be obtained by using a film of polyethylene, polypropylene, polyurethane, polycarbonate, polystyrene, polyamide, polyvinyl chloride, cellophane, acetate, or teflon.

Further, as described above, the reinforcing adhesive tape 8*c* is attached to the seamed portion 8*a* of the belt such that it is inclined with respect to the line L, which is perpendicular to the direction of movement of the conveyor belt, so that when the tape end portions are folded over so as not to stand out at the ends with respect to the width direction of the belt, the end portions of the adhesive tape are superimposed one upon the other so as be out of alignment with each other. That is, as shown, for example, in FIG. 3, the end portion R2 on the obverse side of the belt is superimposed on the end portion R1 on the back side of the belt so as to be out of alignment with each other with respect to the direction in which the belt runs.

Suppose this construction is not adopted and the end portions R1 and R2 of the adhesive tape 8*c* are superimposed one upon the other so as to fit together. In that case, when the belt passes the driving roller 12, etc., the seamed portion of the belt would mean an abrupt change in the thickness of the belt, though it depends on the thickness of the adhesive tape 8*c*. Such an abrupt change in thickness would cause concentration of stress, thereby allowing cracks to be easily generated in the belt portions extending along the end surface lines (the edge portions) where the end portions of the adhesive tape 8*c* are superimposed one upon the other so as to fit together.

With the construction of this embodiment, it is possible to prevent the generation of such cracks.

It has been confirmed that, in accordance with this embodiment, described above, the service life of the belt can be increased from the conventional 250 revolutions per hour to 500 to 600 revolutions per hour. This means double the conventional service life or more.

While the above embodiment has been described with reference to an endless conveyor belt serving as the endless conveying means for the recording material, it goes without saying that the present invention is also applicable to an image forming apparatus in which, as is well known, a belt-like photosensitive member is used as the image carrying means for carrying a toner image. That is, it is possible to use a belt-like photosensitive member having a construction as shown in FIGS. 1 through 4.

What is claimed is:

1. An image forming apparatus comprising:

a movable belt member including a seamed portion and an elongated reinforcing member which is attached to said seamed portion and which reinforces said seamed portion;

rollers for supporting and feeding said belt member; and image forming means for forming an image on said belt member or on a recording material carried by said belt member, wherein said reinforcing member is arranged lengthwise at an acute coplanar angle from a line which is perpendicular to a direction of movement of said belt member and which is coplanar with said belt member.

2. An image forming apparatus according to claim 1, wherein said seamed portion is provided so as to be parallel to said direction which is perpendicular to the direction of movement of said belt member.

3. An image forming apparatus according to claim 1, wherein said reinforcing member is provided with a folded portion positioned at an end of said belt member with respect to the direction perpendicular to the direction of movement of said belt member, said folded portion being formed by folding over the end portion of said reinforcing member from the obverse to the reverse side of said belt member.

4. An image forming apparatus according to claim 3, wherein end portions of said reinforcing member with respect to the direction of movement of said belt member are arranged such that the end portion on the obverse side of said belt member and the end portion on the reverse side of said belt member are not exactly superimposed one upon the other but out of alignment with each other with respect the direction of movement of said belt member.

5. An image forming apparatus according to claim 1, wherein said apparatus has a cleaning blade for cleaning said belt member and wherein a line in which the cleaning blade is in contact with said belt member is parallel to said line which is perpendicular to the direction of movement of said belt member and which is coplanar with said belt member.

6. An image forming apparatus according to claim 1, wherein said apparatus has a plurality of image bearing members and wherein images of plurality of colors are transferred from said plurality of image bearing members to the recording material carried by said belt member.

7. An image forming apparatus comprising:

a moveable belt member including a seamed portion and a reinforcing member which is attached to said seamed portion and which reinforces said seamed portion;

rollers for supporting and feeding said belt member; and image forming means for forming an image on said belt member or on a recording material carried by said belt member, wherein said reinforcing member is provided with a folded portion positioned at an end of said belt member with respect to the direction perpendicular to the direction of movement of said belt member, said folded portion being formed by folding over the end portion of said reinforcing member from the obverse to the reverse side of said belt member.

8. An image forming apparatus according to claim 7, wherein said seamed portion is arranged so as to be parallel to said direction which is perpendicular to the direction of movement of said belt.

9. An image forming apparatus according to claim 7, wherein end portions of said reinforcing member with respect to the direction of movement of said belt member are arranged such that the end portion on the obverse side of said belt member and the end portion on the reverse side of said belt member are not exactly superimposed one upon the other but out of alignment with each other with respect to the direction of movement of said belt member.

10. An image forming apparatus according to claim 7, wherein said apparatus has a plurality of image bearing members and wherein images of plurality of colors are transferred from said plurality of image bearing members to the recording material carried by said belt member.

11. An image forming apparatus comprising:

a movable belt member including a seamed portion and an elongated reinforcing member which is attached to said seamed portion and which reinforces said seamed portion;

rollers for supporting and feeding said belt member;

image forming means for forming an image on said belt member or on a recording material carried by said belt member; and a cleaning blade for cleaning said belt member, wherein said reinforcing member is arranged lengthwise at an acute coplanar angle from a line parallel to a line in which said cleaning blade is in contact with said belt member.

12. An image forming apparatus according to claim 11, wherein said apparatus has a plurality of image bearing members and wherein images of plurality of colors are transferred from said plurality of image bearing members to the recording material carried by said belt member.

13. A belt member which is movable and which is for use in an image forming apparatus, said belt member comprising:

a seamed portion;

a reinforcing member which is attached to said seamed portion to reinforce said seamed portion, wherein said reinforcing member is arranged lengthwise at an acute coplanar angle from a line which is coplanar with said belt member and perpendicular to a direction of movement of said belt member.

14. A belt member according to claim 13, wherein said seamed portion is arranged so as to be parallel to said direction which is perpendicular to the direction of movement of said belt member.

15. A belt member according to claim 13, wherein said reinforcing member is provided with folded portion positioned at an end of said belt member with respect to the direction perpendicular to the direction of movement of said belt member, said folded portion being formed by folding over the end portion of said reinforcing member from the obverse to the reverse side of said belt member.

16. A belt member according to claim 15, wherein end portions of said reinforcing member with respect to the direction of movement of said belt member are arranged such that the end portion on the obverse side of said belt member and the end portion on the reverse side of said belt member are not exactly superimposed one upon the other but out of alignment with each other with respect to the direction of movement of said belt member.

17. A belt member which is moveable and which is for use in an image forming apparatus, said belt member comprising:

a seamed portion;

a reinforcing member which is attached to said seamed portion to reinforce said seamed portion, wherein said reinforcing member is provided with folded portion positioned at an end of said belt member with respect to a direction which is perpendicular to the direction of movement of said belt member, said folded portion being formed by folding over the end portion of said reinforcing member from the obverse to the reverse side of said belt member.

18. A belt member according to claim 17, wherein said seamed portion is arranged so as to be parallel to said direction which is perpendicular to the direction of movement of said belt member.

19. A belt member according to claim 17, wherein the end portions of said reinforcing member with respect to the direction of movement of said belt member are arranged such that the end portion on the obverse side of said belt member and the end portion on the reverse side of said belt member are not exactly superimposed one upon the other but out of alignment with each other with respect to the direction of movement of said belt member.

* * * * *

UNITED STATES PATENT AND TRADEMARK OFFICE

CERTIFICATE OF CORRECTION

PATENT NO. : 6,009,290

DATED : December 28, 1999

INVENTOR(S): YOSHINORI MOCHIDA

It is certified that error appears in the above-identified patent and that said Letters Patent is hereby corrected as shown below:

COVER PAGE AT ITEM [56] RC:
Foreign Patent Documents: "11/1917" should read --11/1988--.

COVER PAGE AT ITEM [57] ABSTRACT:
Line 18, "respect" should read --respect to--.

COLUMN 2:
Line 10, "made" should read --is made--;
Line 27, "seam" should read --seamed--; and
line 28, "portioned" should read --portion--.

COLUMN 7:
Line 41, "the" should read --to the--.

COLUMN 8:
Line 54, "with" should read --with the--.

UNITED STATES PATENT AND TRADEMARK OFFICE

CERTIFICATE OF CORRECTION

PATENT NO. : 6,009,290

DATED : December 28, 1999

INVENTOR(S): YOSHINORI MOCHIDA

It is certified that error appears in the above-identified patent and that said Letters Patent is hereby corrected as shown below:

COLUMN 9:

Line 7, "with" should read --with the--.

Signed and Sealed this

Twenty-third Day of January, 2001

*Attest:*

*Attesting Officer*

Q. TODD DICKINSON

*Commissioner of Patents and Trademarks*